United States Patent [19]

Yarnell

[11] Patent Number: 4,665,840

[45] Date of Patent: May 19, 1987

[54] MECHANICAL STOKER

[76] Inventor: Garrett D. Yarnell, 605 Jolene Dr., West Chester, Pa. 19380

[21] Appl. No.: 885,024

[22] Filed: Jul. 14, 1986

[51] Int. Cl.[4] ..... F23K 3/18

[52] U.S. Cl. ..... 110/113; 110/109; 110/278; 110/282; 110/328

[58] Field of Search ..... 110/101 R, 102, 109, 110/113, 114, 218–219, 223, 263, 267, 278, 281–282, 286, 289, 290, 293, 298–300, 104 R, 105, 327–328; 414/160, 187, 198, 304

[56] References Cited

U.S. PATENT DOCUMENTS

| | | | |
|---|---|---|---|
| 513,244 | 1/1894 | Newton | 110/281 |
| 2,195,278 | 3/1940 | Leas | 110/109 |
| 2,204,555 | 6/1940 | Valentine et al. | 110/109 |
| 2,932,264 | 4/1960 | Hurst | 110/282 X |
| 3,241,506 | 3/1966 | Miner, Jr. | 110/113 |
| 4,537,140 | 8/1985 | Baker | 110/281 |

*Primary Examiner*—Albert J. Makay
*Assistant Examiner*—Steven E. Warner
*Attorney, Agent, or Firm*—Louis S. Gillow

[57] ABSTRACT

An improvement for use in a mechanical stoker with a coal stove is disclosed. The improvement device is used with a stoker, generally including a hopper, operatively connected to a small stove having a fire box forming an ash pit. The fire box, through its sides sloping downward from the hopper, supports a ramp. The lower portion of the ramp is a perforated fire grate, while the upper portion is a plate that extends through the hopper bottom and into the stove. A fan effecting a forced draft through the grate is operatively connected to a fan motor. The improvement comprises a wiper bar which overlies generally the width of the plate. The wiper bar oscillates about the longitudinal center line of the plate to feed coal or other solid fuels from the hopper onto the grate. The oscillation of the wiper bar is effected by eccentric connection to a gear motor. When coal is fed into the hopper and the wiper bar is activated by the gear motor, the wiper bar will move in oscillation so that coal falling on the ramp from the hopper will continually advance in an even flow from the leading edge of the plate onto the grate.

9 Claims, 6 Drawing Figures

MECHANICAL STOKER

BACKGROUND OF THE INVENTION

This invention relates to a mechanical stoker with an oscillating wiper bar for advancing fuel in an even flow from a hopper onto a fire grate.

DESCRIPTION OF THE PRIOR ART

Prior art stokers aid in the movement of coal from a hopper to a fire grate. However, the prior art does not satisfy the need for an even flow of solid fuel so that complete burning can be accomplished within a small stove.

U.S. Pat. No. 2,204,555 to Valentine and Hurst discloses a pusher arm in order to advance the coal. U.S. Pat. No. 4,537,140 discloses a reciprocating carpet to advance the coal. The use of such an arm or carpet does not provide an even flow of fuel as they cause the coal to aggregate. These aforementioned devices also require the use of a relatively large motor.

There is a long-felt need for a device to advance the fuel from the hopper onto the fire grate in a small stove. None of these prior art devices evenly feed the coal into a small stove. There is also a need for a mechanical stoker which evenly feeds coal into a small stove.

SUMMARY OF DISCLOSURE

The improved mechanical stoker of this invention is intended for use in a small stove which includes a hopper with a lower forward passage. A fire box forming an ash pit is attached forward of and aligned with the hopper's lower forward passage. The fire box includes sides sloping downward from the lower forward passage that support a ramp also with sloping sides. The ramp includes a perforated fire grate at its lower portion and a solid plate at its upper portion which also extends generally from the lower forward passage of the hopper into the stove. A motor runs a fan to force air upwardly through the perforations of the grate.

This invention comprises a wiper bar which is positioned on the plate and is transversely aligned between the sloping sides. The wiper bar is oscillated by an eccentric movement activated by a gear motor. When coal is fed into the hopper and the wiper bar is activated by the gear motor, the wiper bar moves in an oscillating motion about the longitudinal center line of the plate. Coal falling from the hopper onto the plate will advance in an even, non-tumbling flow from the forward edge of the wiper bar onto the perforated fire grate so as to cause a complete burn out within the small stove.

It is an object of this invention to provide an improved mechanical stoker that uses oscillating movement to assist the gravity flow of coal from the hopper onto the fire grate.

It is another object of this invention to provide an improved device to evenly feed coal onto the fire grate for complete combustion within a small stove.

It is a further object of this invention to provide an improved mechanical stoker device that utilizes a minimum of simple mechanical parts.

It is still another object of this invention to provide an improved mechanical stoker with a wiper bar oscillating within angular limits which are easily adjustable to change the speed of the feed of coal onto the fire grate.

It is yet another object of this invention to provide an improved mechanical stoker that can be added to existing coal or other solid fuel burning stoves.

These and other objects will be apparent to one skilled in the art by reference to the following description:

DETAILED DESCRIPTION OF THE PREFERRED EMBODIMENTS

Figure 2:
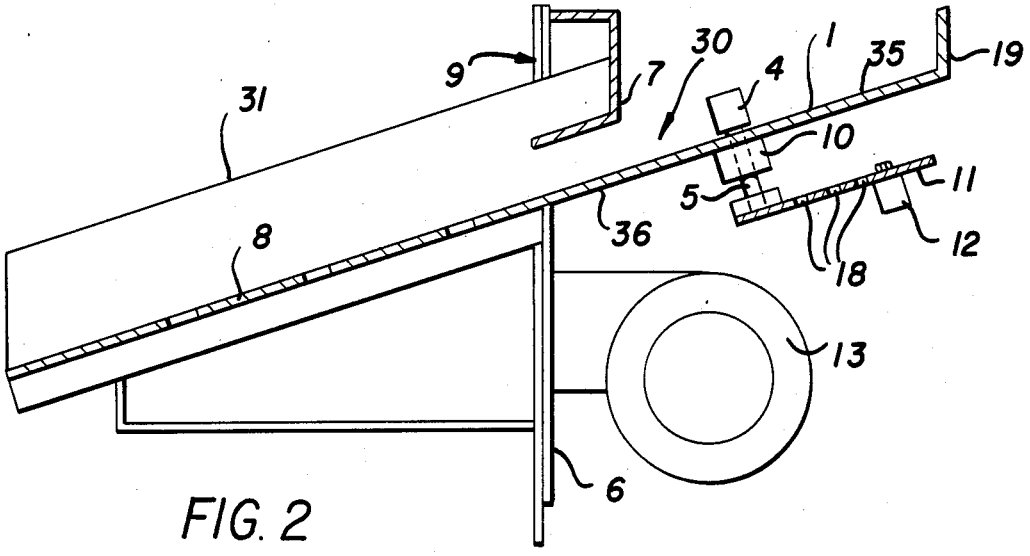
FIG. 2 is a partial sectional view of the device taken along lines 2—2 of FIG. 1.
Figure 1:
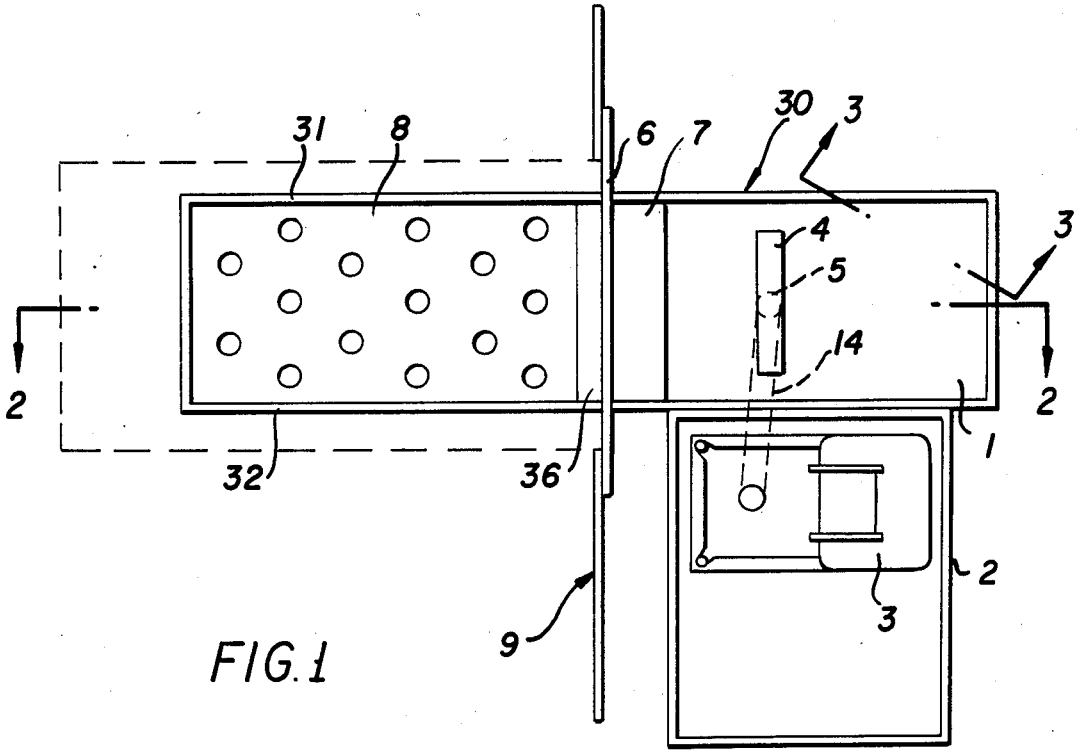
FIG. 1 is a plan view of a preferred embodiment of the improved device of the present invention.

Referring now to FIGS. 1 and 2 showing the improved mechanical stoker device of this invention, generally referred to as 30, which includes an inclined passage or ramp 36 having two parallel sloping sides, 31 and 32. The ramp's base at its higher portion is a plate 1. The ramp's base at its lower portion is a perforated fire grate 8. Mounted on top of the plate 1 transversely between the sloping sides 31 and 32 is a wiper bar 4, with a central shaft 5 which is connected to the wiper bar 4 and runs through the plate 1. A fixed level dam 7 is connected to the sloping sides 31 and 32 at an even distance above the plate 1 which dam 7 permits fresh rice coal to pass under the dam 7 and onto the perforated fire grate 8. The wiper bar 4 is activated by a gear motor 3 positioned upon a gear motor mounting box 2 located in proximity to the wiper bar 4. The gear motor 2 is eccentrically connected to the wiper bar 4 through a threaded rod 14 which oscillates the wiper bar 4 pursuant to rotation of the gear motor 3. The stoker 30 is attached to the fire box 33 of a stove, generally described as 9, by a mounting plate 6.

Figure 3:
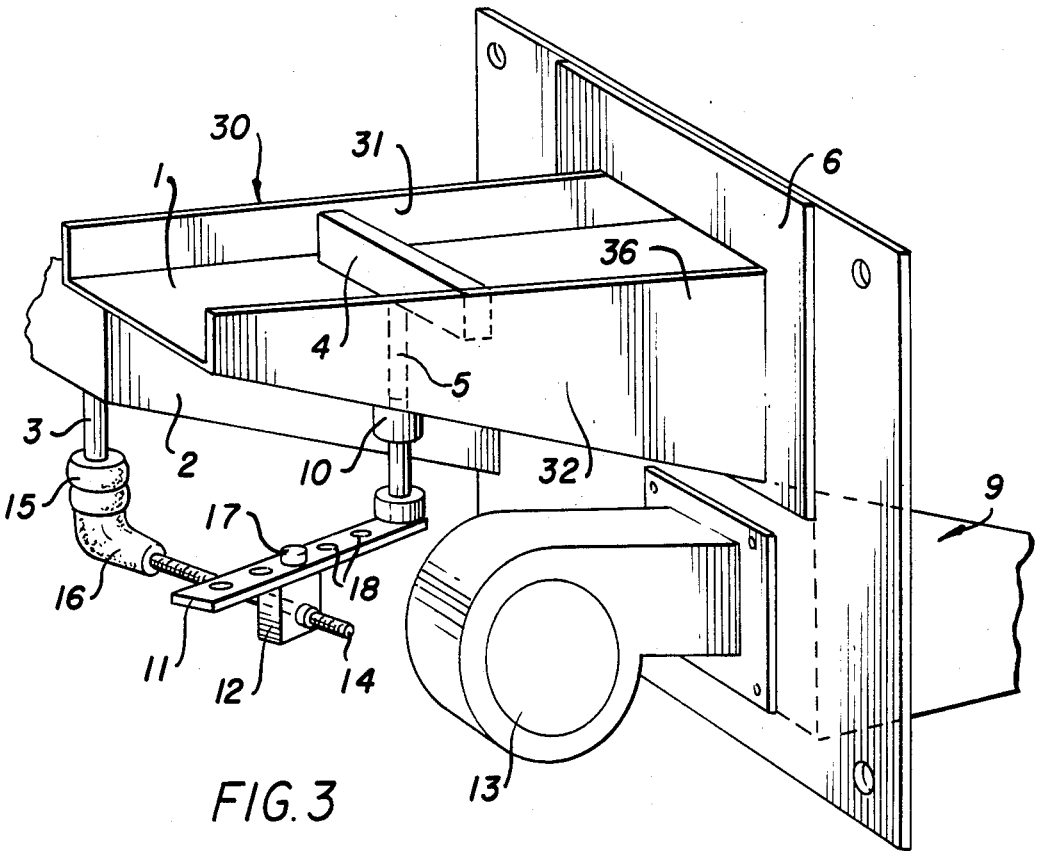
FIG. 3 is a partial perspective view of the device taken along lines 3—3 of FIG. 1.
Figure 4:
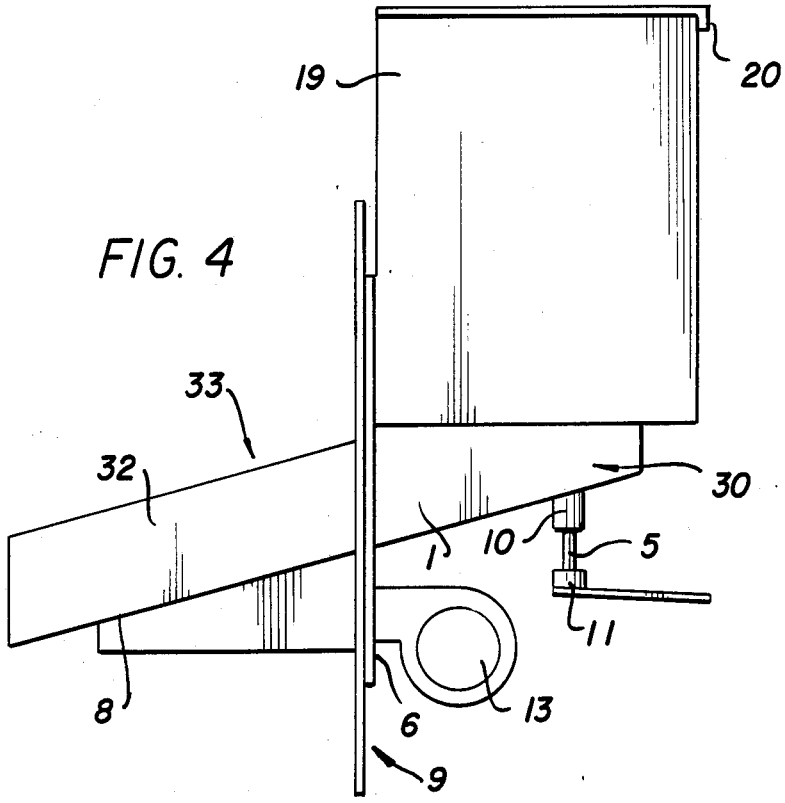
FIG. 4 is a side view of the device.

Referring now to FIGS. 3 and 4, there is shown in greater detail a wiper bar 4 which is connected by its central shaft 5 below a plate 1 to an adjustable cam 11. The wiper bar 4 is maintained in close contact with the plate 1 by a bushing boss 10 on the central shaft 5 below the plate 1. An adjustable swivel 12 is attached to the adjustable cam 11. The adjustable swivel 12 can be removed from the adjustable cam 11 and relocated into different, predetermined positioning holes 18 so as to cause a longer or shorter adjustable cam 11. The adjustable swivel 12 is adjustably attached to a threaded rod 14 at the distal end from the gear motor 3. The proximate end of the threaded rod 14 terminates with a sperco swivel end 16 which is mounted on a gear motor cam 15 that is rotated by the gear motor 3. A squirrel cage blower and fan motor 13 is also attached to the mounting plate 6 so as to force air from outside the stove 9 into the fire box 33. The forced air enters the fire box 33 and passes from below and through the perforated fire grate 8. A coal hopper 19 is provided with a lid 20 to contain fresh rice coal during operation of the stoker 30. Alternatively, the top of the hopper can be connected to a storage bin for continuous feeding of fresh rice coal 21.

Figure 5:
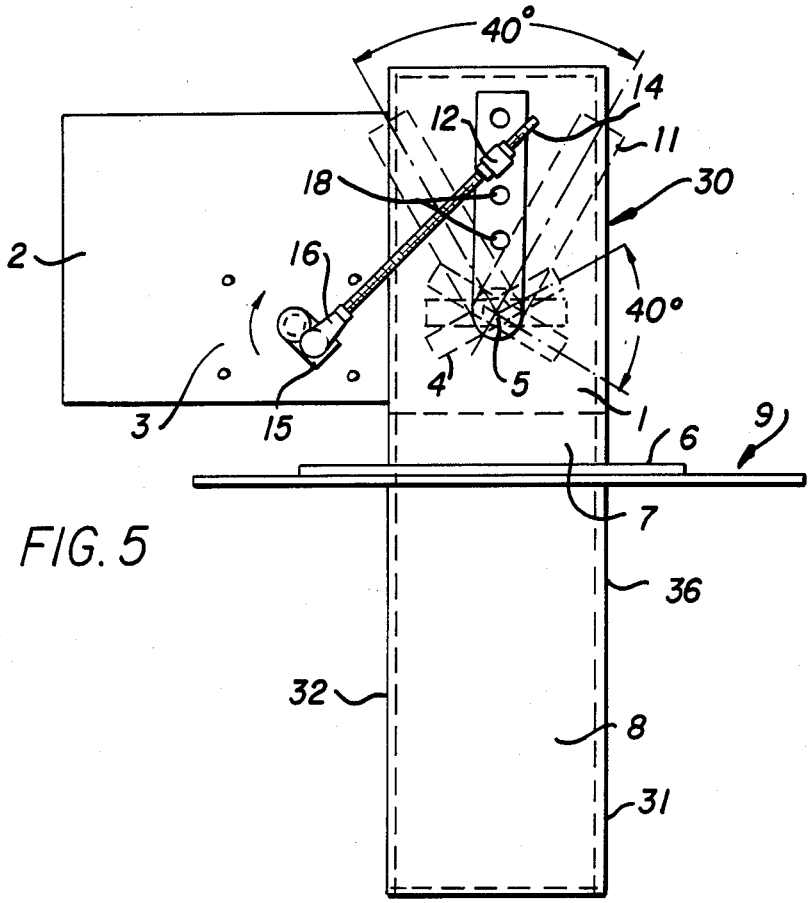
FIG. 5 is a bottom view of the device.

Referring now to FIG. 5, there is shown the rotation of the gear motor cam 15 which is attached to the sperco swivel end 16 by lock nuts 17 on the proximate end of threaded rod 14. On the distal end of the threaded rod 14 is the adjustable swivel 12 which is attached to the adjustable cam 11. The rotation of the gear motor 3 causes the adjustable cam to oscillate through an arc of preferably about 40 degrees, which is 20 degrees to each side of the longitudinal center line of the wiper bar 4. This oscillation of the adjustable cam 11 creates a corresponding 40 degree oscillation of the wiper bar 4 which creates a positive force for pushing fresh rice coal that falls onto the plate 1 by gravity force downward from the hopper 19.

Figure 6:
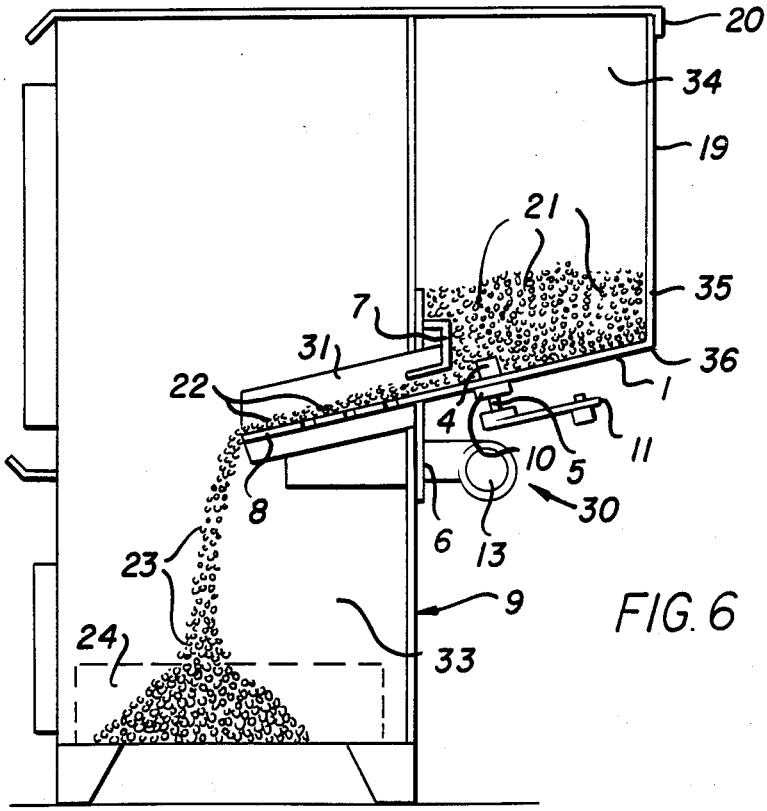
FIG. 6 is a side sectional view of the device showing its method of operation with the stove and the hopper.

Referring now to FIG. 6, the method of operation of the improved device of the present invention is demonstrated. Fresh rice coal 21 is fed into the coal hopper 19 and falls by gravity onto the plate 1. The fresh rice coal 21 is pushed by the force of the oscillating wiper bar 4 transmitted by the gear motor 3 through the adjustable cam 11. The fresh rice coal 21 passes under the fixed level coal dam 7 onto the perforated fire grate 8. The action of the squirrel cage blower and fan motor 13 forces combustion air up through the perforations of the fire grate 9, which, when combined with the heat of the stove 9, causes the fresh rice coal 21 to be converted into burning coal 22. As the burning coal 22 is combusted, it is converted into coal ash 23 which falls off of the perforated fire grate 8 and into the ash pit 24.

Having described the invention in detail and by reference to the drawings, it will be apparent that no modifications are possible without departing from the spirit and scope of the invention defined by the following claims:

What is claimed is:

1. In a coal stove having a mechanical stoker, including a hopper with a lower forward passage, a base box forming an ash pit, a ramp, said ramp including a perforated fire grate at the lower portion of said ramp, and a plate at the upper portion of said ramp, with the plate extending generally through said hopper's bottom, and a motor including a shaft, the improvement of the mechanical stoker comprising a wiper bar overlying generally the width of said plate, said wiper bar operatively connected to said motor by eccentric movement means, said means including:

(a) a central shaft of said wiper bar extending through and below said plate, (b) an adjustable cam connected to said central shaft, (c) an adjustable swivel connected to said adjustable cam, (d) a swivel end attached to said motor shaft, and (e) a threaded rod connecting the adjustable cam and the swivel end, so that when said motor is activated, said motor shaft's 360 degree revolution causes said adjustable cam to oscillate, thereby oscillating said wiper bar correspondingly which forces the coal falling on said plate from said hopper to continually advance from said wiper bar's leading edge onto said grate in an even flow.

2. The improved mechanical stoker according to claim 1 wherein said ramp also includes a fixed coal level dam mounted above the plate and transverse to the direction of the coal so as to provide a restricted opening above said plate for the even and continual advance of coal from the plate onto said grate.

3. The improved mechanical stoker according to claim 1 wherein said stoker includes an open storage bin connecting with the top of said hopper for the continuous feeding of fuel to the stoker.

4. The improved mechanical stoker according to claim 1 wherein said hopper includes a removable top.

5. The improved mechanical stoker according to claim 1 wherein said motor is an electric motor.

6. The improved mechanical stoker according to claim 1 wherein said adjustable cam can be increased or decreased in length by varying the position of its connection to the threaded rod which thereby varies the angle of oscillation of the wiper bar which controls the speed of advance of the coal from said wiper bar's leading edge onto said grate in an even flow.

7. The improved mechanical stoker according to claim 6 wherein said adjustable cam adjustments are two or more positioning holes along the length of said adjustable cam for connection to said threaded rod.

8. The improved mechanical stoker according to claim 1 wherein said perforated fire grate includes a means for affecting a forced draft through the fire grate.

9. The improved mechanical stoker according to claim 8 wherein said means for affecting a forced draft is a fan.

* * * * *